US005757270A

United States Patent [19]

Mori

[11] Patent Number: 5,757,270

[45] Date of Patent: May 26, 1998

[54] ANTITHEFT DEVICE

[75] Inventor: Nobuyuki Mori, Kawasaki, Japan

[73] Assignee: Fujitsu Limited, Kawasaki, Japan

[21] Appl. No.: 691,802

[22] Filed: Aug. 2, 1996

[30] Foreign Application Priority Data

Jan. 18, 1996 [JP] Japan ..... 8-006802

[51] Int. Cl.[6] ..... G08B 13/14

[52] U.S. Cl. ..... 340/568; 340/571; 340/572

[58] Field of Search ..... 340/568, 566, 340/571, 572, 573, 683, 686, 687, 689, 440

[56] References Cited

U.S. PATENT DOCUMENTS

| | | | |
|---|---|---|---|
| 3,892,295 | 7/1975 | Hahto | 188/111 |
| 4,260,982 | 4/1981 | DeBenedictis et al. | 340/539 |
| 4,651,157 | 3/1987 | Gray et al. | 342/457 |
| 4,740,775 | 4/1988 | Price | 340/429 |
| 4,870,405 | 9/1989 | Fletcher | 340/568 |
| 4,908,627 | 3/1990 | Santos | 342/125 |
| 5,017,913 | 5/1991 | Kaneko et al. | 345/177 |
| 5,068,643 | 11/1991 | Yashina | 340/568 |
| 5,130,695 | 7/1992 | Scarbrough et al. | 340/568 |
| 5,258,743 | 11/1993 | Nelson et al. | 340/568 |
| 5,311,423 | 5/1994 | Clark | 348/401 |
| 5,317,304 | 5/1994 | Choi | 340/568 |
| 5,459,447 | 10/1995 | Snyder et al. | 340/568 |
| 5,510,765 | 4/1996 | Madau | 340/429 |
| 5,574,429 | 11/1996 | Streeter | 340/568 |
| 5,646,616 | 7/1997 | Komatsu | 340/988 |

FOREIGN PATENT DOCUMENTS

| | | | |
|---|---|---|---|
| 3-225597 | 4/1991 | Japan | G08B 13/183 |

*Primary Examiner*—Brent A. Swarthout
*Assistant Examiner*—Van T. Trieu
*Attorney, Agent, or Firm*—Staas & Halsey

[57] ABSTRACT

An antitheft device is provided which is attached to a product such as an OA apparatus for detecting theft of the product and issuing an alarm. When vibration is detected by a vibration sensor, move distance estimating means estimates a distance of movement of the product from the start of vibration based on the time interval between vibrations detected by the vibration sensor and the number of times vibration is repeated. When the estimated distance of movement has become greater than or equal to a predetermined distance, alarming means issues an alarm by means of a speaker or the like. Schedule management means causes monitoring to be executed only in a preset day(s) of the week or in a preset time zone.

11 Claims, 14 Drawing Sheets

ANTITHEFT DEVICE

BACKGROUND OF THE INVENTION (1) Field of the Invention

The present invention relates to an anti theft device attached to a product, such as an OA apparatus, for issuing an alarm upon detecting theft of the product, and more particularly, to an antitheft device designed to detect theft on the basis of generation of vibration.

Products which are easy to carry, such as CDs or videotapes, are very liable to be stolen. Usually, therefore, such products are fitted up with small-sized antitheft devices.

(2) Description of the Related Art

A technique employed in conventional antitheft devices is disclosed, for example, in Unexamined Japanese Patent Publication (KOKAI) No. 3-225597. The antitheft device disclosed in this publication includes a vibration sensor and a light sensor, and when vibration is detected by the vibration sensor and also a specified time has elapsed after the transition from brightness to darkness detected by the light sensor, an alarm is issued.

However, commodities are often moved from one place to another in a store for rearrangement or the like, and thus the conventional antitheft device can erroneously operate to issue an alarm each time an article is moved. OA apparatus such as personal computers, in particular, are frequently moved in an office, and therefore, inconvenience arises if an alarm is issued each time an OA apparatus is moved.

To cope with such situations, the aforementioned Unexamined Japanese Patent Publication No.3-225597 discloses a technique whereby, when a transition from brightness to darkness is detected by the light sensor, it is judged that the commercial article is stolen and put into a bag or the like, thereby making it possible to distinguish movement for rearrangement etc. from theft. If, however, theft is committed without blocking off light, then the technique is of no effect. Further, in the case of OA apparatus and the like, the antitheft device need be located inside an apparatus, and therefore, a device using a light sensor cannot be used.

A conventional antitheft device designed to be arranged inside an apparatus such as an OA apparatus operates in a manner interlocked with a mechanism in the apparatus. Accordingly, technical knowledge is required to incorporate such a device, and once the device is incorporated, it cannot be easily detached. Further, the antitheft device is increased in overall size.

SUMMARY OF THE INVENTION

An object of the present invention is to provide an antitheft device which can be reduced in size, is easy to attach to and detach from a product, and which can detect theft with reliability.

To achieve the above object, there is provided an antitheft device which is attached to a product, such as an OA apparatus, for detecting theft of the product and issuing an alarm. The antitheft device comprises a battery for supplying power, a vibration sensor for detecting a vibration of specified magnitude or more, move distance estimating means for estimating a distance of movement of the product from a start of vibration based on a time interval between vibrations detected by the vibration sensor and a number of times vibration is repeated, and alarming means for issuing an alarm when the estimated distance of movement has become greater than or equal to a predetermined distance.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

An embodiment according to the present invention will be hereinafter described with reference to the drawings.

Figure 1:
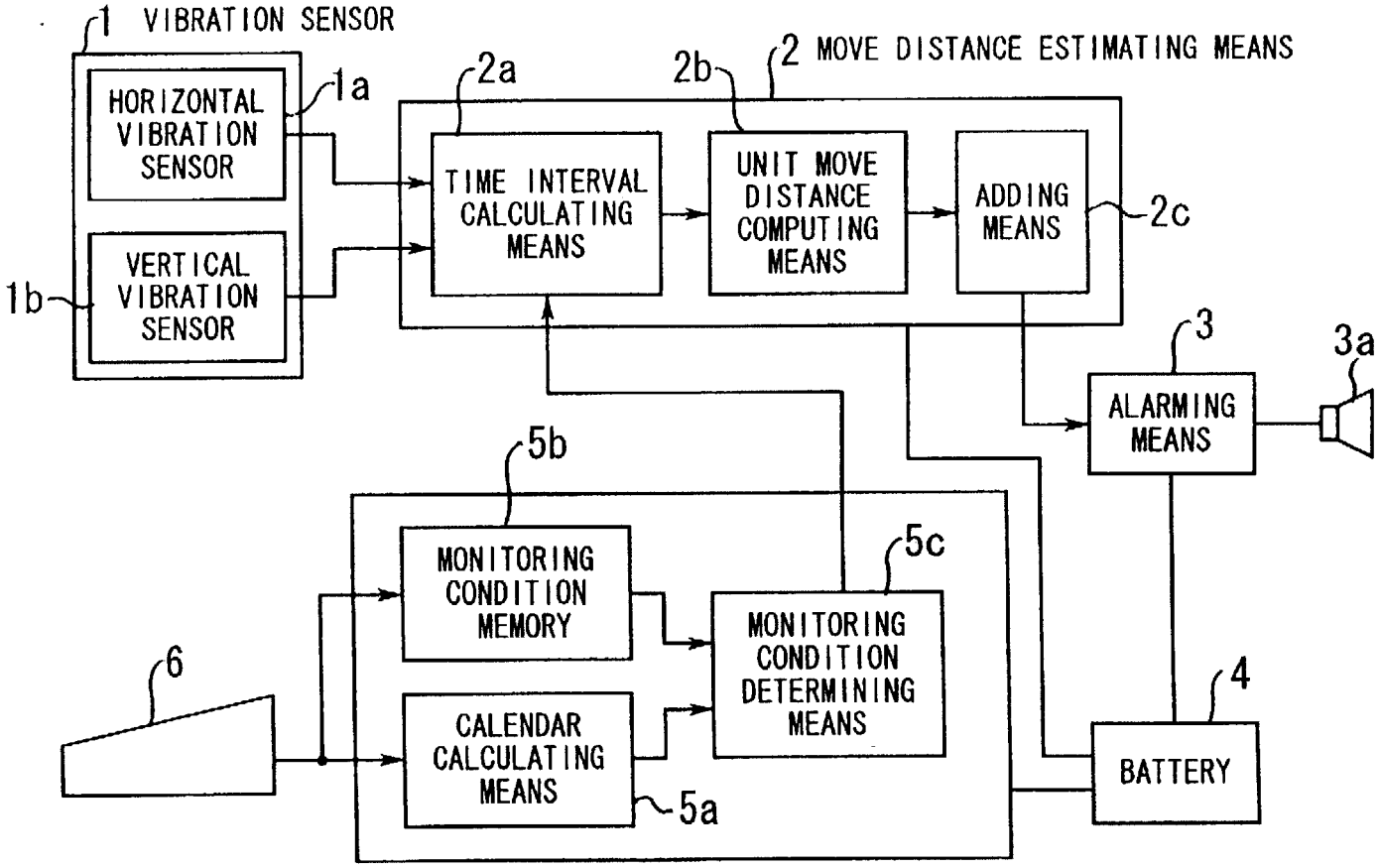
FIG. 1 is a diagram illustrating the principles of an antitheft device according to one embodiment.

FIG. 1 illustrates the principles of an antitheft device according to the embodiment. Schedule management means 5 is supplied with calendar data such as current time, day, month and year, and monitoring condition data such as a day(s) of the week, time zone, etc. to be monitored, through operating keys 6 and the like. Using the input calendar data as a start point of time, calendar calculating means 5*a* keeps counting by means of counters therein to update the current time, date, day of the week, etc. The input monitoring condition data is stored in a monitoring condition memory 5*b*. Monitoring condition determining means 5*c* determines whether or not the current calendar data fulfills the monitoring condition, and if the monitoring condition is fulfilled, sends a monitoring command to time interval calculating means 2*a*.

A vibration sensor 1 includes horizontal vibration sensor 1*a* for detecting horizontal vibration and a vertical vibration sensor 1*b* for detecting vertical vibration. Vibration detection signals from the horizontal and vertical vibration sensors 1*a* and 1*b* are supplied to the time interval calculating means 2*a* of move distance estimating means 2. While being supplied with the monitoring command from the monitoring condition determining means 5*c*, the time interval calculating means 2*a* calculates the time interval between a previous vibration detection signal and a current vibration detection signal. Based on the calculated time interval,unit move distance computing means 2*b* computes a unit distance of movement estimated to have been traversed during the interval from the previous vibration detection signal to the current vibration detection signal.

Adding means 2*c* adds up the unit move distances computed by the unit move distance computing means 2*b* from the start of vibration. When the resultant sum has become greater than or equal to a predetermined distance, alarming means 3 sounds an alarm from a speaker 3*a*.

Figure 2:
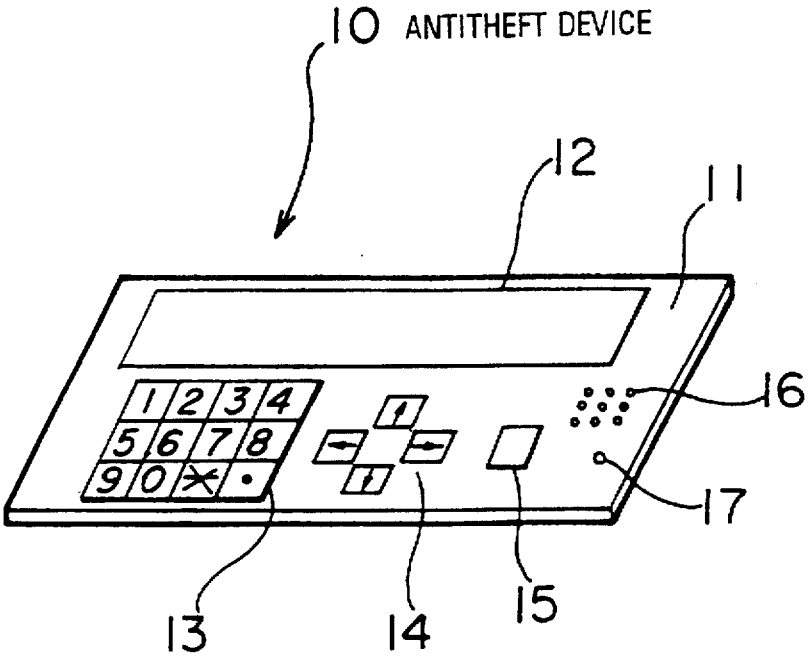
FIG. 2 is a perspective view showing the external appearance of the antitheft device.

FIG. 2 is a perspective view showing the external appearance of the antitheft device. The antitheft device 10 as a whole is in the form of a card having a width of 5 to 10 cm, a depth of about 5 cm and a thickness of about 5 mm. On an operation panel 11 are provided a liquid crystal display screen 12, a numeric keypad 13, cursor keys 14, an enter key 15, a sound output section 16, and a reset button 17.

The display screen 12 displays calendar data such as current time, day, month and year, monitoring condition data such as a day(s) of the week, time zone, etc. to be monitored, setup data such as a password, data entry messages requesting entry of such data items, etc. Also, the input data is displayed on the display screen 12 for operator's confirmation. Following a data entry message, the operator pushes the numeric keypad 13 or the cursor keys 14 to input various data. The enter key 15 is used to conclusively set the input data. The sound output section 16 sounds an alarm of theft. The reset button 17, when pressed with a thin rod-like member, clears the data already entered.

The antitheft device 10 described above is immovably fixed inside a product such as an OA apparatus, for example, a hard disk unit, by using an adhesive double coated tape or the like.

Figure 3:
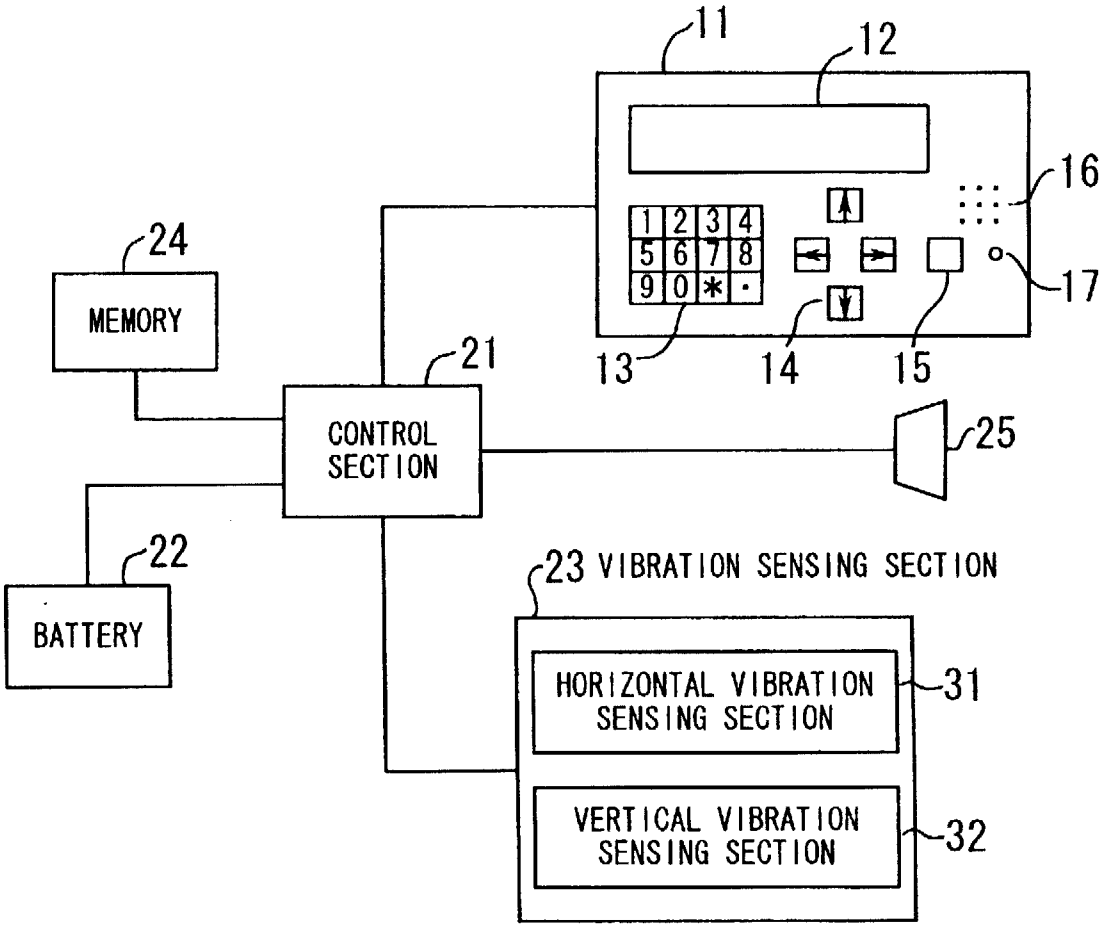
FIG. 3 is a block diagram showing the configuration of hardware inside the antitheft device.

FIG. 3 is a block diagram showing the configuration of hardware inside the anti theft device 10. A control section 21 comprises a logic circuit and is operated by electric power from a battery 22. The control section 21 controls the entire operation of the antitheft device 10 according to a flowchart described later. The battery 22 is a button-type battery such as a mercury battery. The power of the battery 22 is supplied to the control section 21 and the operation panel 11. A vibration sensing section 23 comprises a horizontal vibration sensing section 31 and a vertical vibration sensing section 32. The arrangements of the horizontal and vertical vibration sensing sections 31 and 32 will be explained later.

Various data entered using the operation panel 11 is stored in a memory 24. The control section 21 rewrites data in the memory 24 in accordance with a monitoring state. Also, following a procedure described later, the control section 21 monitors theft, and when theft is detected, sounds an alarm from a speaker 25.

Figure 4A:
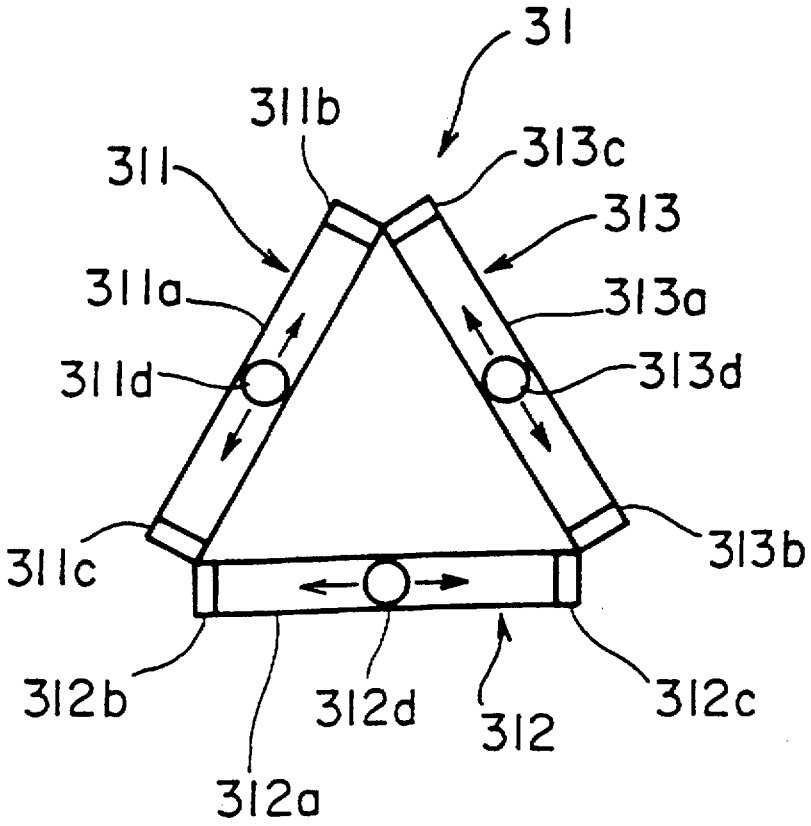
FIG. 4(A) is a diagram functionally illustrating the arrangement of a horizontal vibration sensor of a vibration sensing section.
Figure 4B:
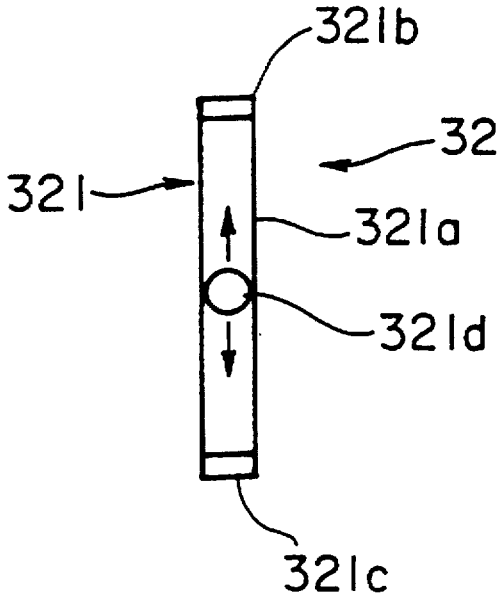
FIG. 4(B) is a diagram functionally illustrating the arrangement of a vertical vibration sensor of the vibration sensing section.

FIGS. 4(A) and 4(B) illustrate the arrangement of the vibration sensing section 23, wherein FIG. 4(A) is a diagram functionally illustrating the arrangement of the horizontal vibration sensing section 31, and FIG. 4(B) is a diagram functionally illustrating the arrangement of the vertical vibration sensing section 32. As shown in FIG. 4(A), the horizontal vibration sensing section 31 comprises three vibration sensors 311, 312 and 313. The vibration sensors 311, 312 and 313 respectively comprise cylindrical cases 311*a*, 312*a* and 313*a*, detecting sections 311*b*, 311*c*; 312*b*, 312*c*; and 313*b*, 313*c*, and movable members 311*d*, 312*d* and 313*d*. These vibration sensors 311, 312 and 313 are each placed such that their cases 311*a*, 312*a* and 313*a* extend parallel with a horizontal plane. Further, the vibration sensors 311, 312 and 313 are oriented such that their cases 311*a*, 312*a* and 313*a* form a regular triangle.

With regard to the vibration sensor 311, the detecting sections 311*b* and 311*c* are arranged at opposite ends of the case 311*a*. Upon detecting contact with the movable member 311*d* which is electrically conductive, the corresponding one of the detecting sections 311*b* and 311*c* supplies a detection signal to the control section 21. The movable member 311*d* is slidably received within the case 311*a*, and in a steady state, it is located at a central position of the case 311*a* by a suspending mechanism, not shown. When acted upon by a vibration of predetermined magnitude or more, the movable member 311*d* moves in the direction of the vibration. The vibration sensors 312 and 313 are substantially identical in arrangement with the vibration sensor 311, and therefore, description thereof is omitted.

The vertical vibration sensing section 32, on the other hand, comprises a single vibration sensor 321, as shown in FIG. 4(B). The vibration sensor 321 is made up of a cylindrical case 321*a*, detecting sections 321*b* and 321*c*, and a movable member 321*d*. This vibration sensor 321 is oriented in the vertical direction.

Like the vibration sensor 311 etc., the detecting sections 321*b* and 321*c* of the vibration sensor 321 are arranged at opposite ends of the case 321*a*. On detecting contact with the movable member 321*d* which also is electrically conductive, the corresponding one of the detecting sections 321*b* and 321*c* supplies a detection signal to the control section 21. The movable member 321*d* is slidably received within the case 321*a*, and in a steady state, it is located at a central position of the case 321*a*. When acted upon by a vibration of predetermined magnitude or more, the movable member 321*d* moves in the direction of the vibration.

The arrangement of the individual vibration sensors is not limited to that shown in FIGS. 4(A) and 4(B), and a vibration sensor of any other arrangement may be used insofar as it is small in size and can detect vibration in an axial direction.

A specific example of an antitheft process executed by the antitheft device 10 constructed as described above will be now explained.

Figure 5:
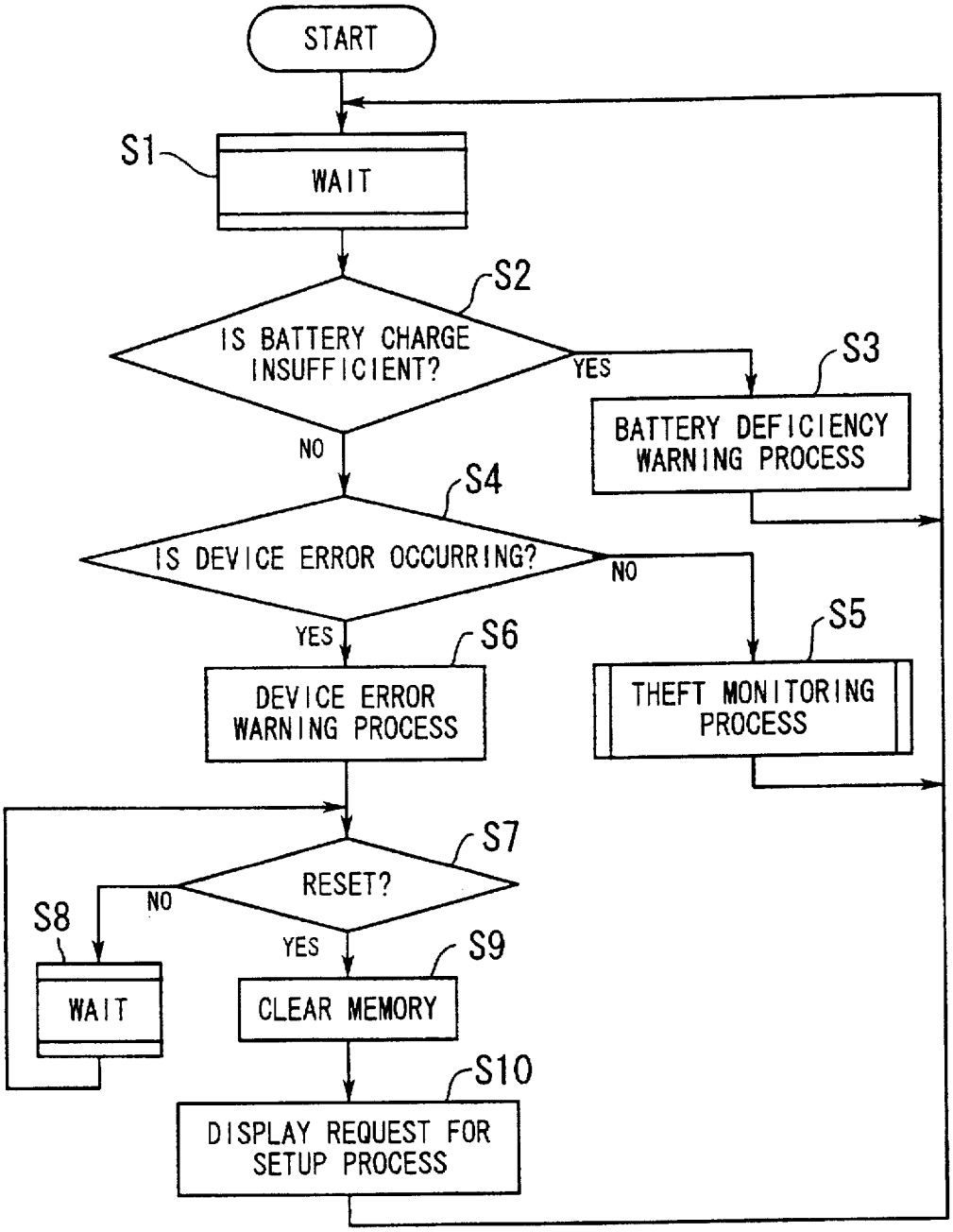
FIG. 5 is a flowchart showing an overall procedure for an antitheft process.

FIG. 5 is a flowchart showing an overall procedure for the antitheft process.

[S1] An external interrupt from the numeric keypad 13 etc. of the operation panel 11 is waited for.

[S2] It is determined whether or not the charge of the battery 22 is insufficient. If the battery charge is insufficient, the flow proceeds to Step S3, and if not, the flow proceeds to Step S4.

[S3] To inform the operator of the insufficient charge of the battery 22, a warning sound is emitted from the speaker 25 and also a warning message is displayed on the display screen 12.

[S4] It is determined whether or not an abnormality such as a memory error is occurring in the antitheft device 10. If an abnormality is occurring, the flow proceeds to Step S6, and if not, the flow proceeds to Step S5.

[S5] An actual theft monitoring process such as a setup process and vibration detection is carried out.

[S6] The occurrence of abnormality of the antitheft device 10 is warned by means of sound and display.

[S7] It is determined whether or not the reset button 17 has been pressed; if the reset button has been pressed, the flow proceeds to Step S9, and if not, the flow proceeds to Step S8.

[S8] Pushing operation of the reset button 17 is waited for.

[S9] Data in the memory 24 is cleared.

[S10] A request for the setup process is displayed.

Figure 6:
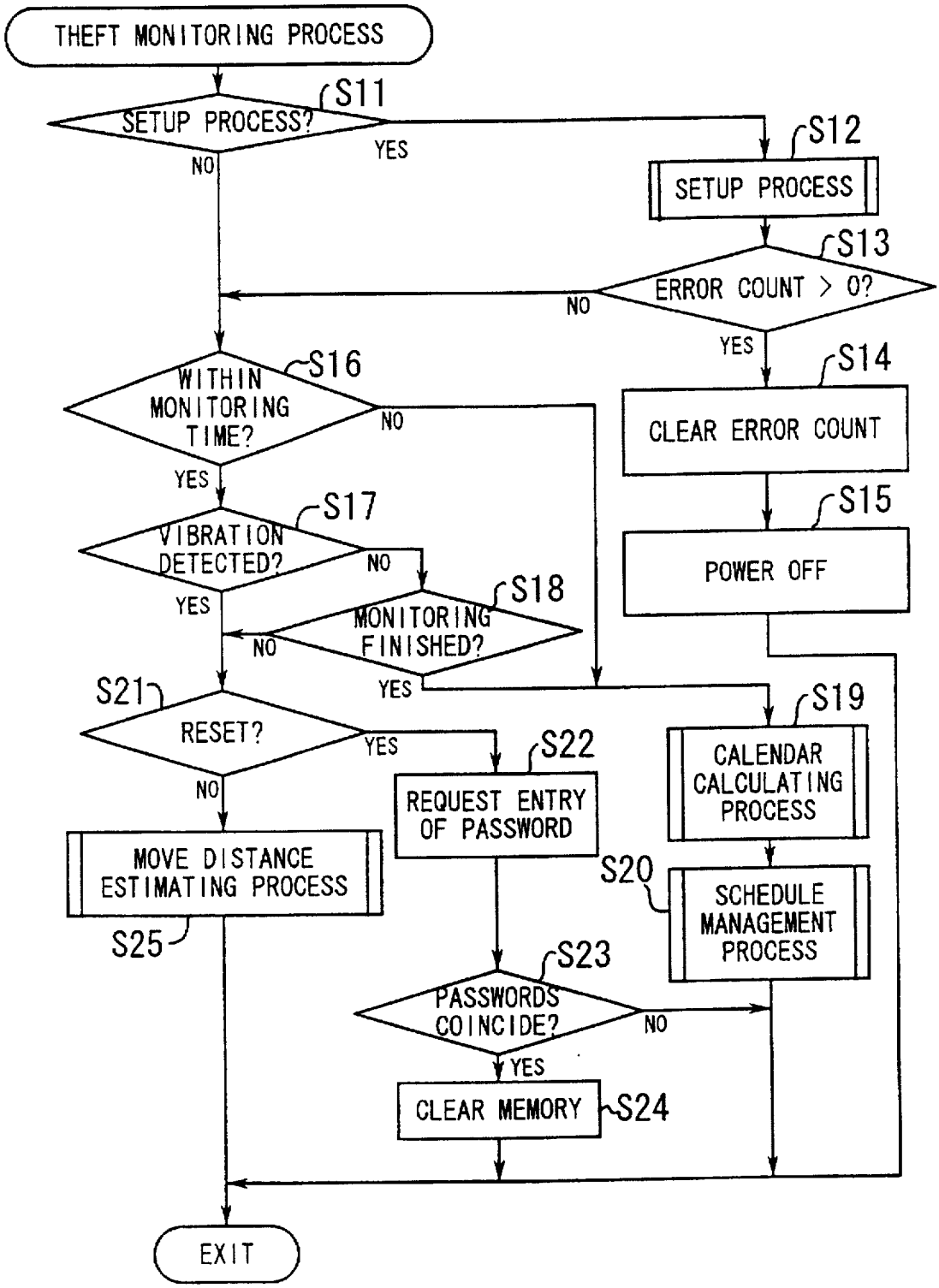
FIG. 6 is a flowchart showing a specific procedure for a theft monitoring process executed in Step S5 in FIG. 5.

FIG. 6 is a flowchart showing a specific procedure for the theft monitoring process executed in Step S5 in FIG. 5.

[S11] It is determined whether or not the interrupt input in Step S1 in FIG. 5 is a command for the setup process. If the interrupt is a command for the setup process, the flow proceeds to Step S12, and if not, the flow proceeds to Step S16.

[S12] The setup process described later is executed.

[S13] It is determined whether or not an error count counted in Step S12 is greater than "0"; if the error count is greater than "0", the flow proceeds to Step S14, and if not, the flow proceeds to Step S16.

[S14] The error count is cleared.

[S15] Supply of power to parts other than those necessary to perform the required functions is cut off.

[S16] It is determined whether or not the current time falls within a monitoring time, by making a determination as to whether or not a monitoring flag, which is set in a schedule management process described later, is ON. If the current time falls within the monitoring time, the flow proceeds to Step S17, and if not, the flow proceeds to Step S19.

[S17] It is determined whether or not a vibration pattern, which is a subject of calculation of a distance of movement in a move distance estimating process described later, is being detected. If such a vibration pattern is being detected, the flow proceeds to Step S21, and if not, the flow proceeds to Step S18.

[S18] It is determined whether or not the theft monitoring has finished; if the theft monitoring has finished, the flow proceeds to Step S19, and if not, the flow proceeds to Step S21.

[S19] A calendar calculation process is executed to request entry of or display calendar data, such as current time, day, month and year.

[S20] The schedule management process for managing the monitoring time is executed.

[S21] It is determined whether or not the reset button 17 has been pressed; if the reset button has been pressed, the flow proceeds to Step S22, and if not, the flow proceeds to Step S25.

[S22] A message requesting the entry of a password is displayed.

[S23] It is determined whether or not the entered password coincides with a password recorded beforehand; if the former coincides with the latter, the flow proceeds to Step S24, and if not, this process is ended.

[S24] Data in the memory 24 is cleared.

[S25] The move distance estimating process described later is executed.

Figure 7:
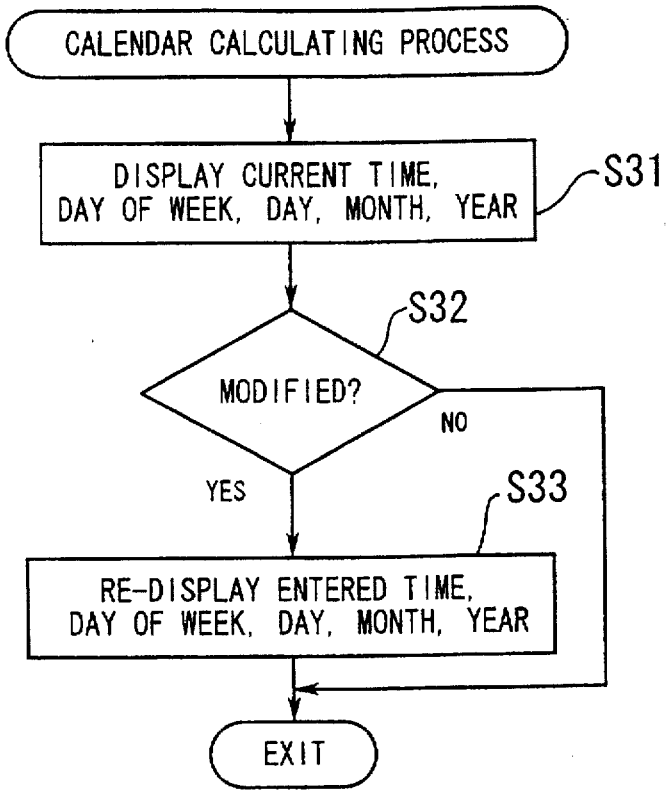
FIG. 7 is a flowchart showing a specific procedure for a calendar calculating process executed in Step S19 in FIG. 6.

FIG. 7 is a flowchart showing a specific procedure for the calendar calculating process executed in Step S19 in FIG. 6.

[S31] The current time, day of the week, day, month and year are displayed. At this time, an option to modify the displayed data is also shown.

[S32] It is determined whether or not the displayed data has been modified. If the displayed data has been modified, the flow proceeds to Step S33, and if not, this process is ended.

[S33] The newly entered time, day of the week, day, month and year are re-displayed.

Figure 8:
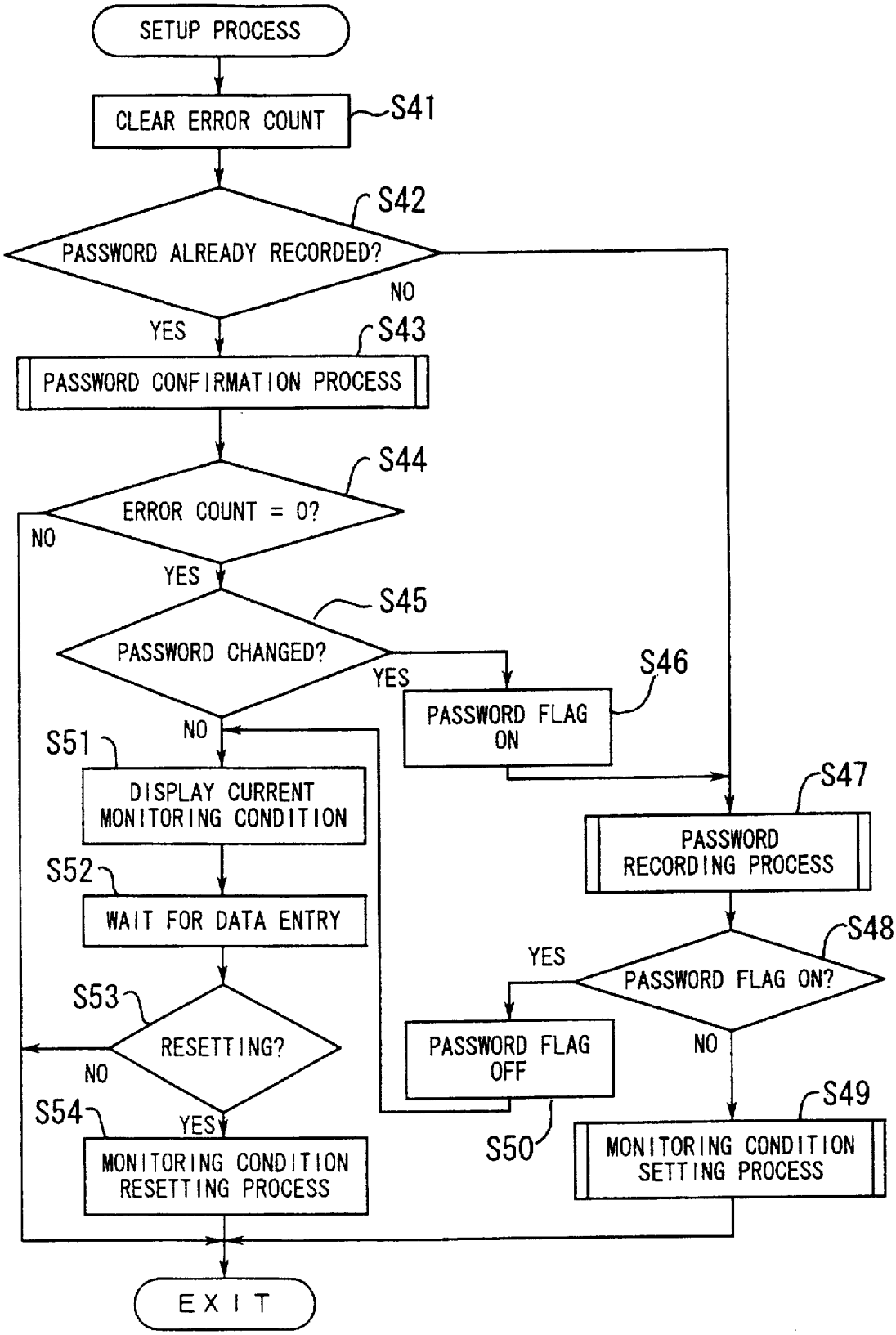
FIG. 8 is a flowchart showing a specific procedure for a setup process executed in Step S12 in FIG. 6.

FIG. 8 is a flowchart showing a specific procedure for the setup process executed in Step S12 in FIG. 6.

[S41] The error count used in a password confirmation process described later is cleared.

[S42] It is determined whether or not a password has been recorded; if a password has been recorded, the flow proceeds to Step S43, and if not, the flow proceeds to Step S47.

[S43] The password confirmation process described later is executed.

[S44] It is determined whether or not the error count equals "0"; if the error count equals "0", the flow proceeds to Step S45, and if not, this process is ended.

[S45] It is determined whether or not the password has been changed in the password confirmation process. If the password has been changed, the flow proceeds to Step S46, and if not, the flow proceeds to Step S51.

[S46] A password flag is set ON.

[S47] A password recording process described later is executed.

[S48] It is determined whether or not the password flag is ON; if the password flag is ON, the flow proceeds to Step S50, and if the flag is OFF, the flow proceeds to Step S49.

[S49] A monitoring condition setting process described later is executed.

[S50] The password flag is set OFF.

[S51] A current monitoring condition is displayed.

[S52] Key-in operation is waited for.

[S53] It is determined whether or not resetting of the monitoring condition has been demanded; if resetting has been demanded, the flow proceeds to Step S54, and if not, this process is ended.

[S54] A process for resetting the monitoring condition is executed. This process is almost identical with that executed in Step S49.

Figure 9:
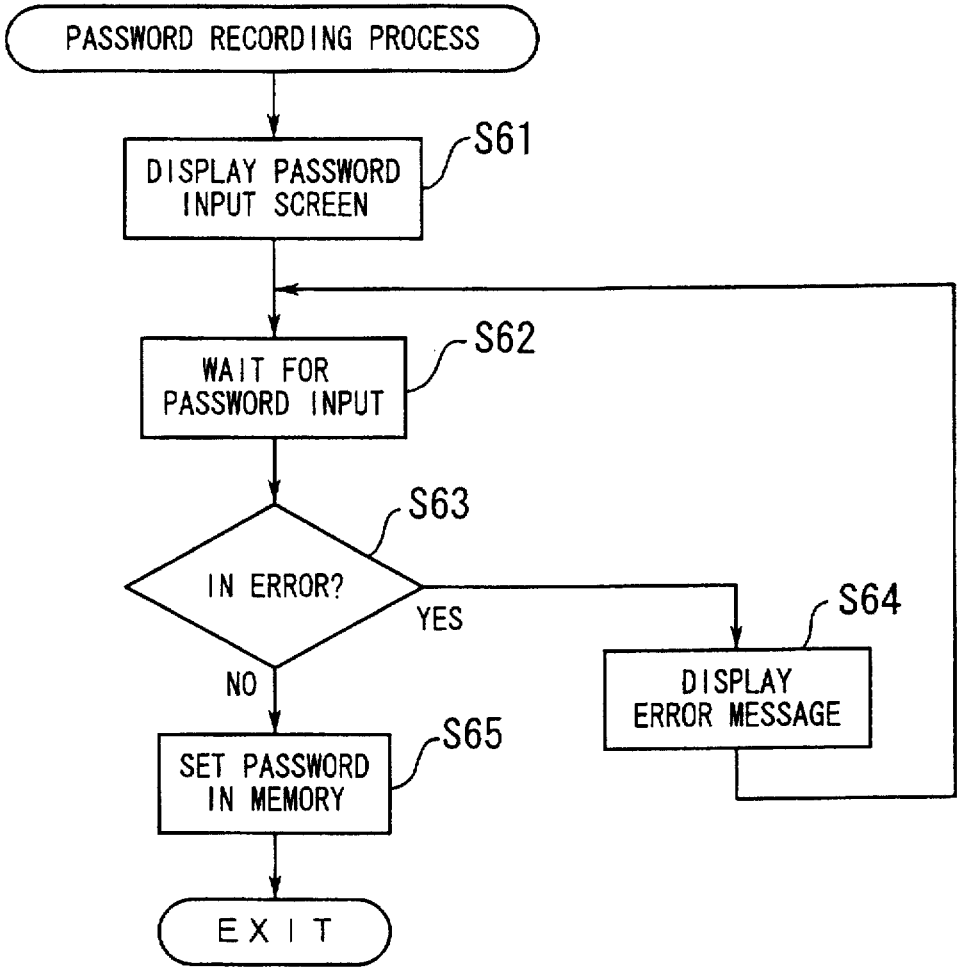
FIG. 9 is a flowchart showing a specific procedure for a password recording process executed in Step S46 in FIG. 8.

FIG. 9 is a flowchart showing a specific procedure for the password recording process executed in Step S46 in FIG. 8.

[S61] A password input screen is displayed.

[S62] Entry of a password is waited for.

[S63] It is determined whether or not the entered password contains an error such as in the number of digits or in the characters used. If an error is contained, the flow proceeds to Step S64, and if not, the flow proceeds to Step S65.

[S64] An error message is displayed, and the flow returns to Step S62.

[S65] The entered password is recorded in the memory 24.

Figure 10:
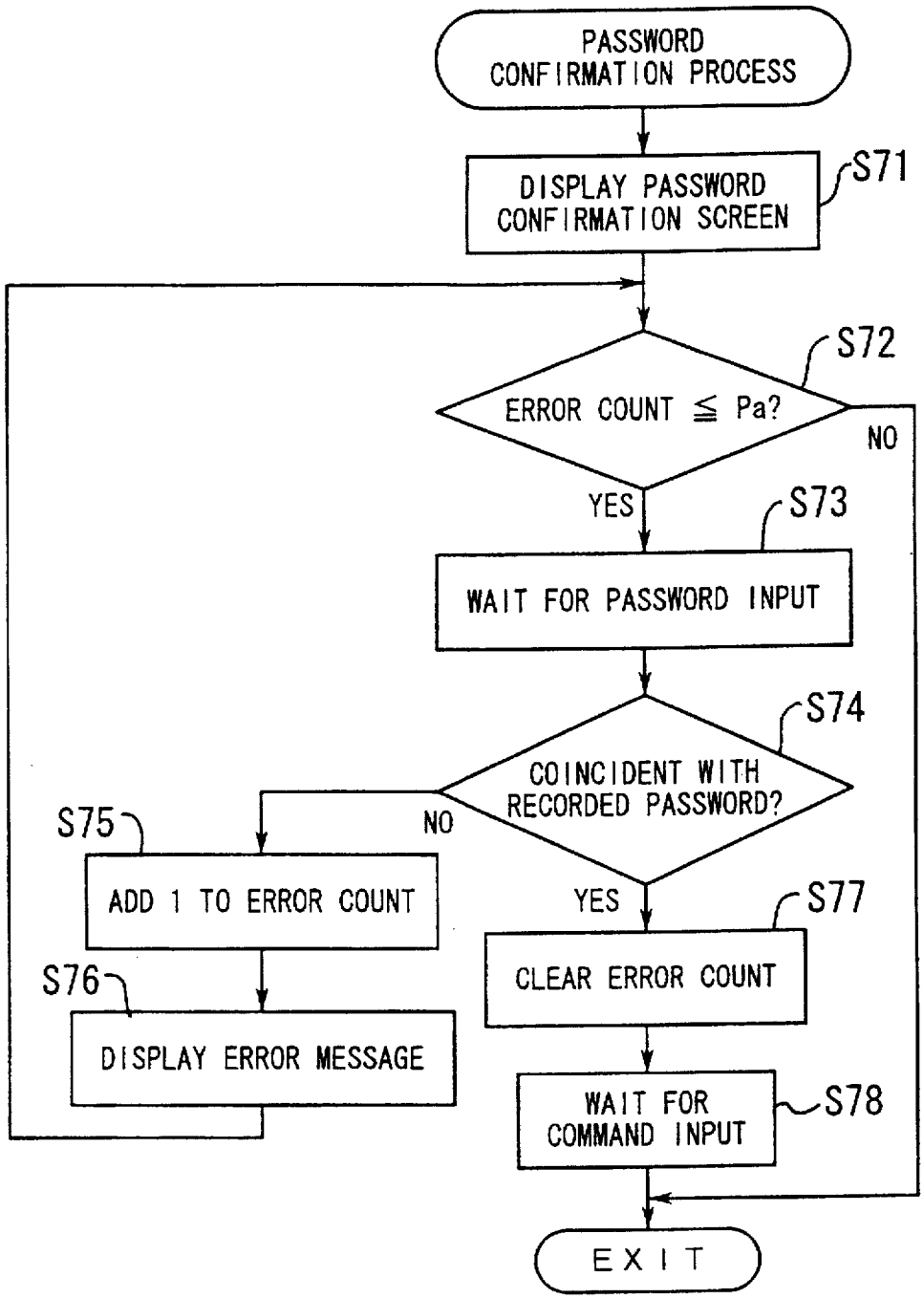
FIG. 10 is a flowchart showing a specific procedure for a password confirmation process executed in Step S43 in FIG. 8.

FIG. 10 is a flowchart showing a specific procedure for the password confirmation process executed in Step S43 in FIG. 8.

[S71] A password confirmation screen is displayed.

[S72] It is determined whether or not the error count, which indicates the number of times an erroneous password has been entered, takes a value smaller than or equal to an allowable number Pa. If the number of times an erroneous password has been entered is smaller than or equal to the allowable number Pa, the flow proceeds to Step S73, and if the allowable number Pa is exceeded, this process is ended.

[S73] Entry of a password is waited for.

[S74] It is determined whether or not the entered password coincides with the recorded password; if the two coincide, the flow proceeds to Step S77, and if not, the flow proceeds to Step S75.

[S75] One ("1") is added to the error count.

[S76] An error message is displayed.

[S77] The error count is cleared.

[S78] A command input is waited for.

Figure 11:
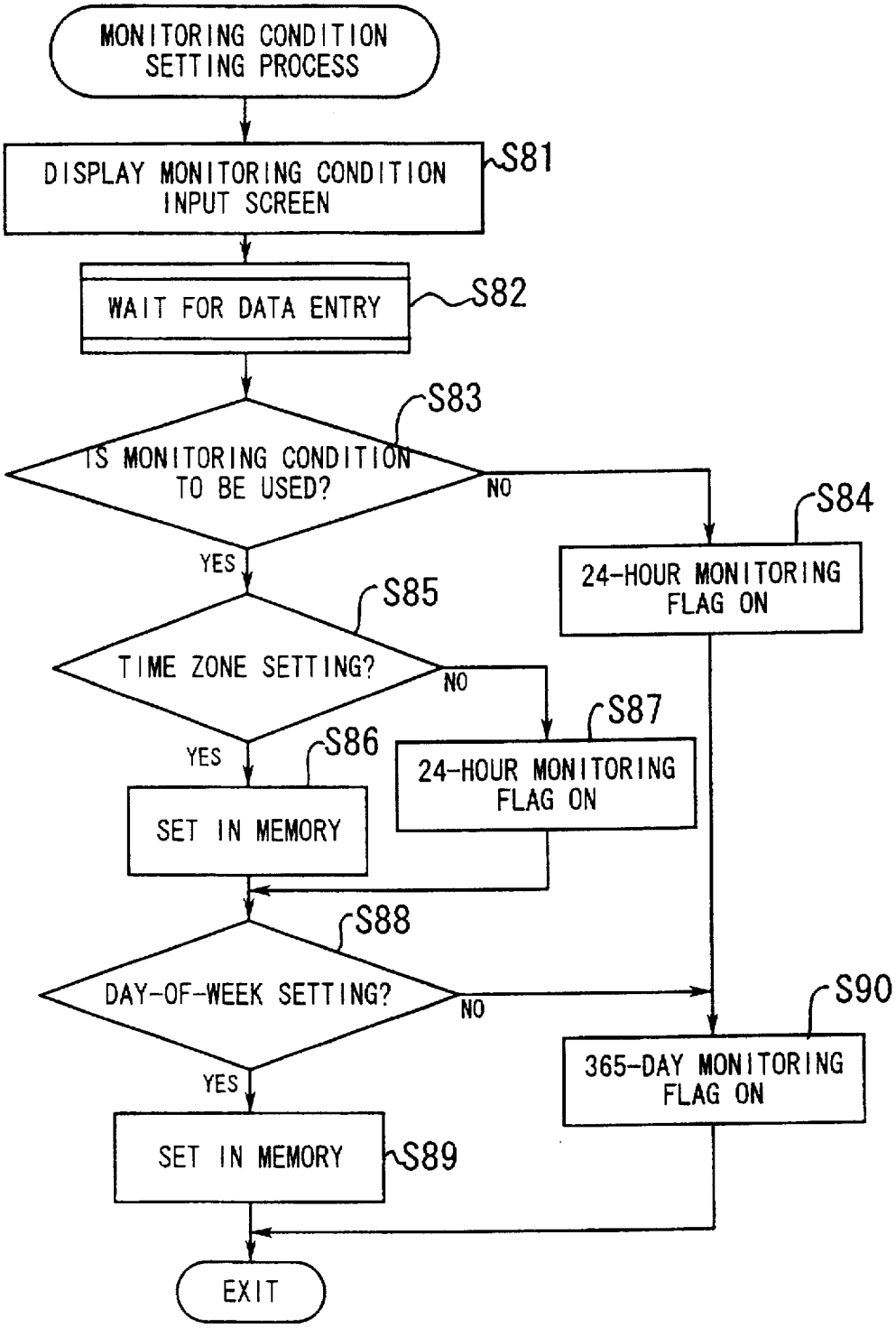
FIG. 11 is a flowchart showing a specific procedure for a monitoring condition setting process executed in Step S48 in FIG. 8.

FIG. 11 is a flowchart showing a specific procedure for the monitoring condition setting process executed in Step S48 in FIG. 8.

[S81] A monitoring condition setting screen is displayed.

[S82] Data entry through keys is waited for.

[S83] It is determined whether or not use of the monitoring condition has been demanded; if the monitoring condition is to be used, the flow proceeds to Step S85, and if monitoring is to be performed at all times without using the monitoring condition, the flow proceeds to Step S84.

[S84] A 24-hour monitoring flag, which indicates the setting for 24-hour monitoring, is set ON.

[S85] It is determined whether or not a time zone monitoring is set; if such setting exists, the flow proceeds to Step S86, and if not, the flow proceeds to Step S87.

[S86] The entered time zone for monitoring is set in the memory 24.

[S87] The 24-hour monitoring flag is set ON.

[S88] It is determined whether or not day-of-the-week setting for monitoring exists; if such setting exists, the flow proceeds to Step S89, and if not, the flow proceeds to Step S90.

[S89] The entered day(s) of the week to be monitored is set in the memory 24.

[S90] A 365-day monitoring flag, which indicates the setting for 365-day monitoring, is set ON.

Figure 12:
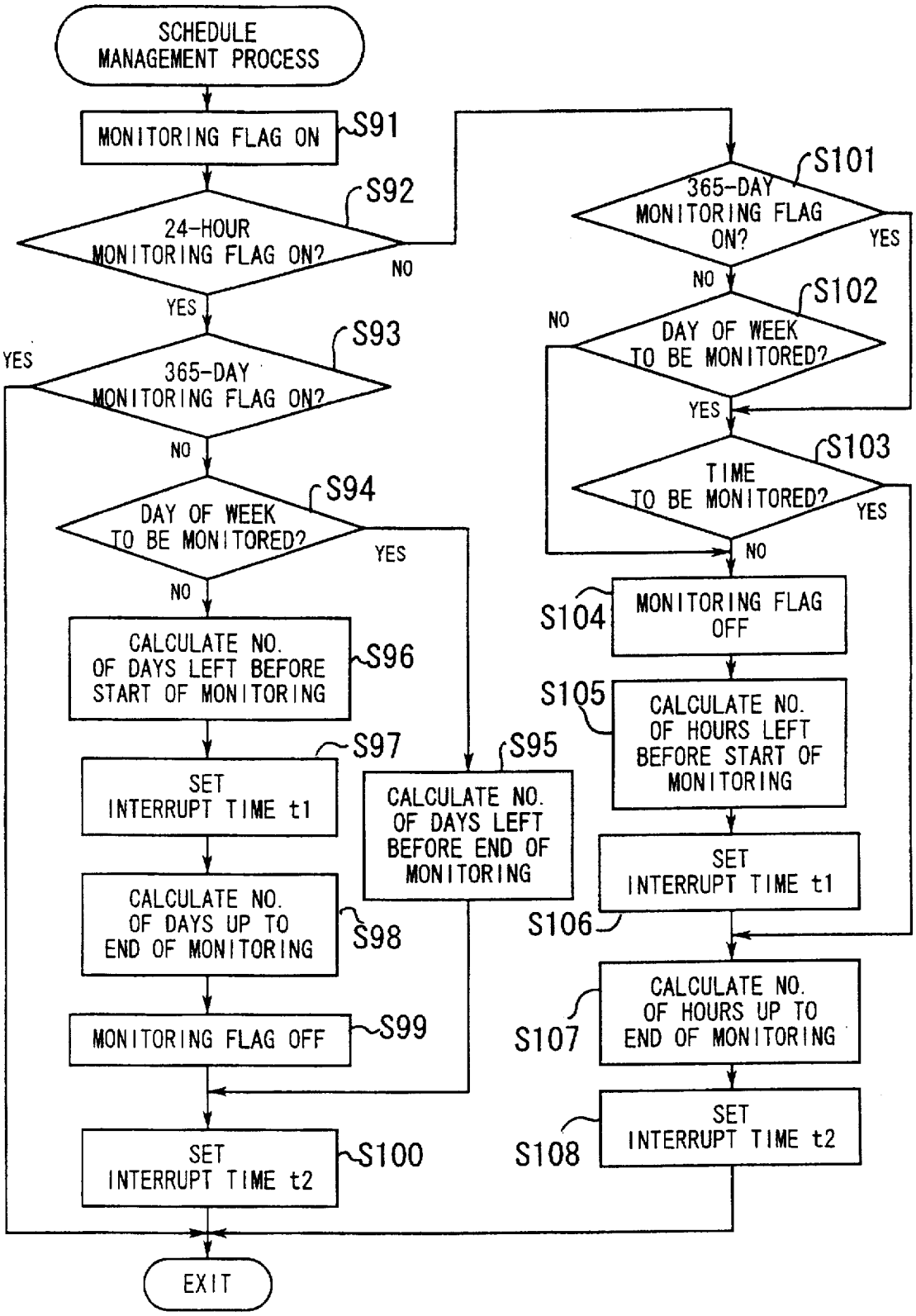
FIG. 12 is a flowchart showing a specific procedure for a schedule management process executed in Step S20 in FIG. 6.

FIG. 12 is a flowchart showing a specific procedure for the schedule management process executed in Step S20 in FIG. 6.

[S91] The monitoring flag which indicates that the monitoring is under execution is set ON.

[S92] It is determined whether or not the 24-hour monitoring flag is ON; if the flag is ON, the flow proceeds to Step S93, and if the flag is OFF, the flow proceeds to Step S101.

[S93] It is determined whether or not the 365-day monitoring flag is ON. If the 365-day monitoring flag is ON, this process is ended, and if the flag is OFF, the flow proceeds to Step S94.

[S94] It is determined whether or not the current day falls within a range of day(s) of the week to be monitored; if the current day falls within the range, the flow proceeds to Step S95, and if not, the flow proceeds to Step S96.

[S95] The number of days left before the end day of the present monitoring term is calculated. This calculation, however, is performed in terms of hours.

[S96] The number of days left before the start day of the upcoming monitoring term is calculated. This calculation also is performed in terms of hour

[S97] The value calculated in Step S96 is set as an interrupt time t1.

[S98] The number of days up to the end day of the upcoming monitoring term is calculated. This calculation is performed in terms of hours.

[S99] The monitoring flag is set OFF.

[S100] The value calculated in Step S95 or S98 is set as an interrupt time t2.

[S101] It is determined whether or not the 365-day monitoring flag is ON; if the flag is ON, the flow proceeds to Step S103, and if the flag is OFF, the flow proceeds to Step S102.

[S102] It is determined whether or not the current day falls within the range of day(s) of the week to be monitored. If the current day falls within the range, the flow proceeds to Step S103, and if not, the flow proceeds to Step S104.

[S103] It is determined whether or not the current time falls within the range of time to be monitored; if the current time falls within the range, the flow proceeds to Step S107, and if not, the flow proceeds to Step S104.

[S104] The monitoring flag is set OFF.

[S105] The number of hours left before the start time of the upcoming monitoring start day is calculated.

[S106] The value calculated in Step S105 is set as the interrupt time t1.

[S107] The number of hours up to the end time of the present monitoring end day is calculated.

[S108] The value calculated in Step S107 is set as the interrupt time t2.

Figure 13:
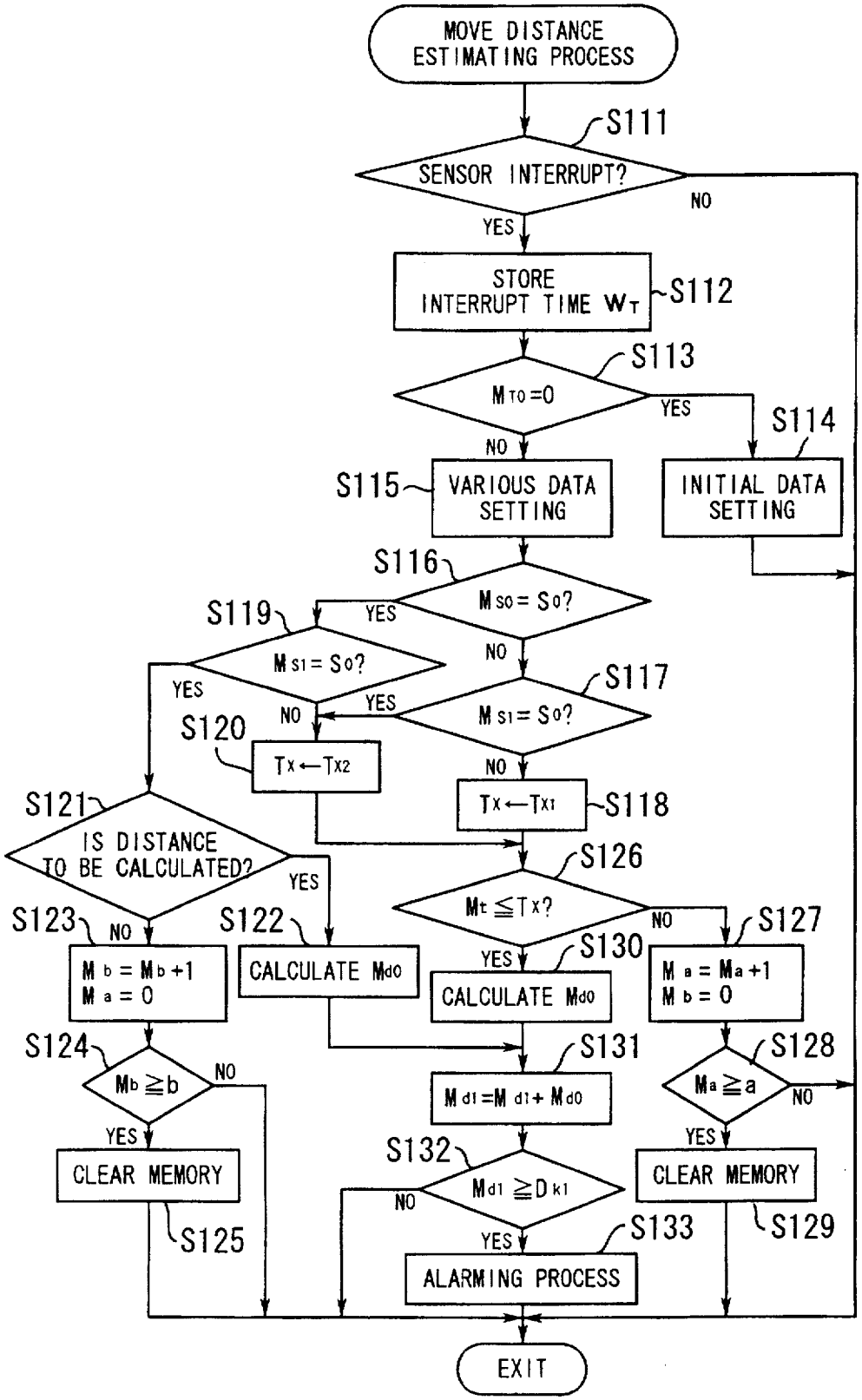
FIG. 13 is a flowchart showing a specific procedure for a move distance estimating process executed in Step S25 in FIG. 6.

FIG. 13 is a flowchart showing a specific procedure for the move distance estimating process executed in Step S25 in FIG. 6.

[S111] It is determined whether or not a vibration detection signal from the vibration sensor 31, 32 has interrupted. If such an interrupt has occurred, the flow proceeds to Step S12, and if not, this process is ended.

[S112] An interrupt time $W_T$ of the vibration detection signal is detected and stored. In this case, the interrupt time $W_T$ is stored in milliseconds.

[S113] It is determined whether or not a variable $M_{TO}$ indicative of the interrupt time equals "0"; if the variable equals "0", the flow proceeds to Step S114, and if not, the flow proceeds to Step S115.

[S114] As an initial data setting process, the interrupt time $W_T$ is set as the variable $M_{TO}$, and the number of an interrupting vibration sensor is set as a variable $M_{sO}$. It is here assumed that the sensor numbers for the vertical and horizontal vibration sensors 32 and 31 are $S_O$ and $S_1$, respectively. In the subsequent cycles of the process, the sensor number of a newly interrupting vibration sensor is set as a variable $M_{s1}$, and the sensor number which was set as $M_{s1}$ at the time of previous interruption is reset as $M_{sO}$.

[S115] It is judged that the detection signal from the vibration sensor 31 or 32 has interrupted twice or more, and the following various data are set. First, the number for the newly interrupting vibration sensor is set as the variable $M_{s1}$. The interrupt time $W_T$ detected this time is set as a variable $M_{T1}$ which stores a new interrupt time. Each time an interrupt is detected, the data of the variable $M_{T1}$ is transferred to the variable $M_{TO}$. Then, the time interval, $M_t=M_{T1}-M_{TO}$, between the preceding interrupt time and the present interrupt time is calculated.

[S116] It is determined whether or not the sensor number set as the variable $M_{sO}$ is $S_O$, that is, whether or not the vibration sensor which caused the previous interrupt is the vertical vibration sensor 32. If the vibration sensor which caused the previous interrupt is the vertical vibration sensor 32, the flow proceeds to Step S119, and if not, the flow proceeds to Step S117.

[S117] It is determined whether or not the sensor number set as the variable $M_{s1}$ is $S_O$, that is, whether or not the vibration sensor which caused the present interrupt is the vertical vibration sensor 32. If the vibration sensor which caused the present interrupt is the vertical vibration sensor 32, the flow proceeds to Step S120, and if not, the flow proceeds to Step S118.

[S118] A time interval comparison value $T_{x1}$, which is set as a parameter beforehand, is set as a variable $T_{x1}$ is set in milliseconds.

[S119] It is determined whether or not the sensor number set as the variable $M_{s1}$ is $S_O$, that is, whether or not the vibration sensor which caused the present interrupt is the vertical vibration sensor 32. If the vibration sensor which caused the present interrupt is the vertical vibration sensor 32, the flow proceeds to Step S120, and if not, the flow proceeds to Step S121.

[S120] A time interval comparison value $T_{x2}$, which is set as a parameter beforehand, is set as the variable $T_x$. $T_{x2}$ also is set in milliseconds.

[S121] It is determined whether or not the current state is a state requiring calculation of the distance of movement. Specifically, a determination is made as to whether or not the vibration time interval $M_t$ fulfills the relation $T_{y1} \leqq M_t \leqq T_{y2}$; if the relation $T_{y1} \leqq M_t \leqq T_{y2}$ is fulfilled, the flow proceeds to Step S122, and if not, the flow proceeds to Step S123. $T_{y1}$ is set to about several milliseconds to several tens of milliseconds, so that when vertical vibrations continually occur at a time interval $M_t$ shorter than $T_{y1}$, it is judged that the vertical vibrations are caused by an earthquake or the like, and not that the product is being moved due to theft. On the other hand, $T_{y2}$ is set to about several seconds, so that when vertical vibrations continually occur at a time interval $M_t$ longer than $T_{y2}$, it is judged that the apparatus to which the antitheft device 10 is attached is being moved together with some other heavy object, such as a desk, for rearrangement or the like, and not that the apparatus is being moved due to theft.

[S122] An estimated value, $M_{d0}=F \times M_t \times \alpha$, of the distance of movement during one vibration interval is calculated. F represents an average human step and is set, for example, to 65 cm, and $\alpha$ represents a coefficient for calculating the distance of movement when vertical vibrations are continually detected, and has a value thereof set beforehand in accordance with the place where the antitheft device 10 is installed, and other factors.

[S123] A variable $M_b$, which indicates the number of times a judgment is made that vertical vibrations detected continually are not the subject of move distance calculation, is set to $M_b=M_b+1$. Simultaneously, a variable $M_a$, which indicates the number of times a judgment is made that at least one detected horizontal vibration is not the subject of move distance calculation, is set to $M_a=0$.

[S124] It is determined whether or not the variable $M_b$ takes a value greater than or equal to a preset number of times b (e.g., five times). If the variable $M_b$ is greater than or equal to the number b, the flow proceeds to Step S125, and if not, this process is ended.

[S125] It is judged that the movements detected continually are not the subject of theft monitoring, and the work area in the memory 24 is cleared.

[S126] It is determined whether or not the time interval $M_t$, at which horizontal vibrations are continually detected or horizontal and vertical vibrations are alternately detected, takes a value smaller than or equal to the variable $T_x$ set in Step S118 or S120. If the time interval $M_t$ is smaller than or equal to the variable $T_x$, it is judged that rapid movement is being caused by theft and thus it is necessary to calculate the distance of the movement; therefore, the flow proceeds to Step S130. On the other hand, if the time interval $M_t$ is greater than the variable $T_x$, it is judged that the detected movement is not caused by theft, and the flow proceeds to Step S127. Usually, $T_{x1}$ and $T_{x2}$ set in Steps S118 and S120, respectively, fulfill the relation $T_{x1} \leqq T_{x2}$. This is presumably because in cases where horizontal vibrations are continually detected ($T_x=T_{x1}$), the movement is taking place at relatively high speed and also vibration time widths are small. Therefore, $T_{x1}$ is set to a small value. On the other hand, in cases where horizontal and vertical vibrations are alternately detected ($T_x=T_{x2}$), presumably the apparatus to which the antitheft device 10 is attached is relatively heavy and moving slowly and also vibration time widths are large. Therefore, $T_{x2}$ is set to a large value.

[S127] The variable $M_a$, which indicates the number of times a judgment is made that horizontal vibration detected at least once is not the subject of move distance calculation, is set to $M_a=M_a+1$. Simultaneously, the variable $M_b$, which indicates the number of times a judgment is made that vertical vibrations detected continually are not the subject of move distance calculation, is set to $M_b=0$.

[S128] It is determined whether or not the variable $M_a$ takes a value greater than or equal to a preset number of times a (e.g., five times); if the variable $M_a$ is greater than or equal to the number a, the flow proceeds to Step S129, and if not, this process is ended.

[S129] It is judged that the movements detected continually are not the subject of theft monitoring, and the work area in the memory 24 is cleared.

[S130] An estimated value, $M_{d0}=T+M_t \times F$, of the distance of movement during one vibration interval is calculated. F represents an average human step and is set, for example, to 65 cm, as mentioned above. T represents a time period (about 585 milliseconds) required for one step motion, provided the average human step is 65 cm and the walking speed is 4 km per hour.

[S131] The sum $M_{d1}$, of the estimated values $M_{d0}$ calculated in Step S122 or S130 is set to $M_{d1}=M_{d1}+M_{d0}$.

[S132] It is determined whether or not the sum $M_{d1}$ takes a value greater than or equal to a preset distance $D_{k1}$; if the sum $M_{d1}$ is greater than or equal to the preset distance $D_{k1}$, the flow proceeds to Step S133, and if not, this process is ended.

[S133] An alarming process is executed in accordance with the value of the sum $M_{d1}$.

Figure 14:
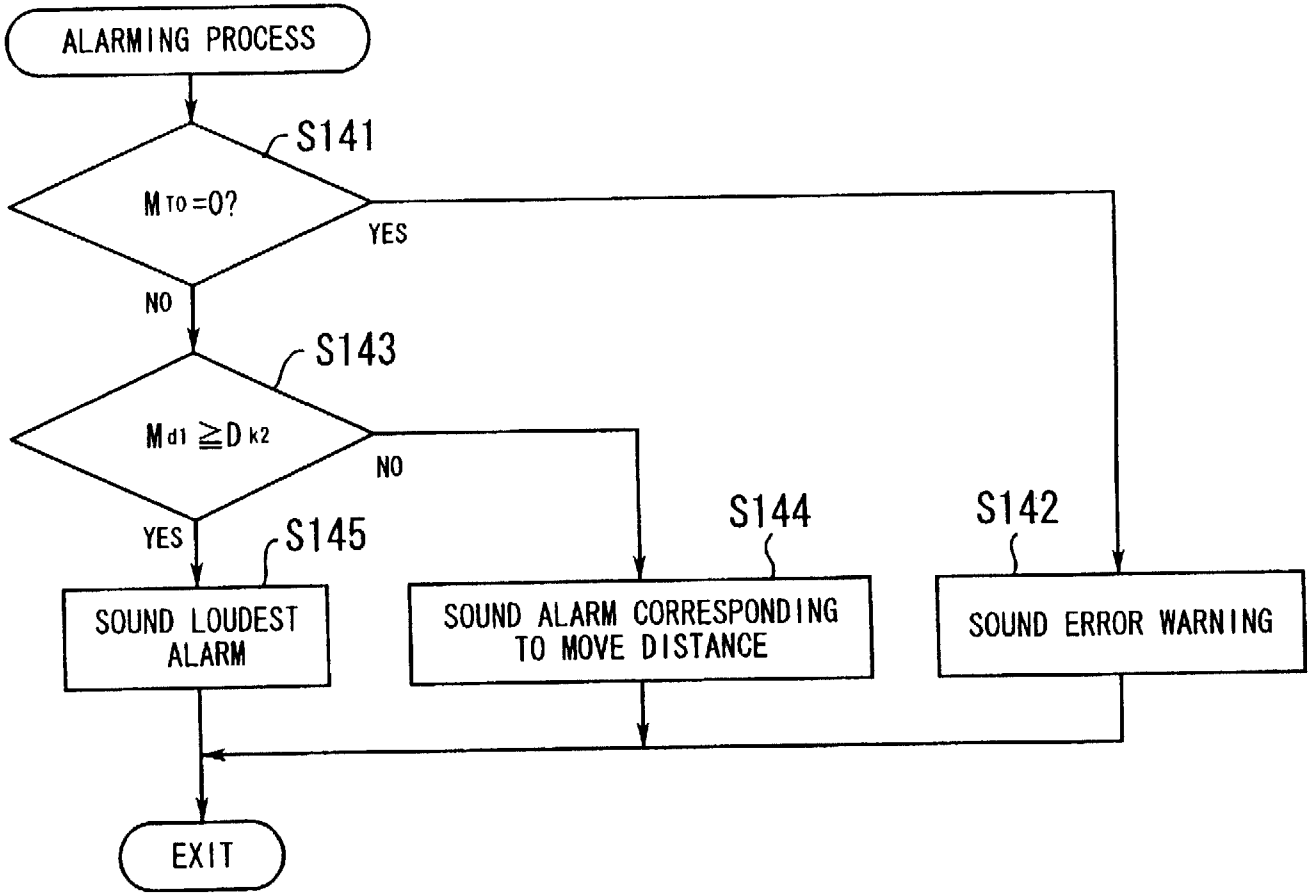
FIG. 14 is a flowchart showing a specific procedure for an alarming process executed in Step S133 in FIG. 13.

FIG. 14 is a flowchart showing a specific procedure for the alarming process executed in Step S133 in FIG. 13.

[S141] It is determined whether or not the relation $M_{T0}=0$ is fulfilled; if the relation $M_{T0}=0$ is fulfilled, the flow proceeds to Step S142, and if not, the flow proceeds to Step S143.

[S142] It is judged that an error has occurred in the memory 24 or the like, and thus an error warning is sounded.

[S143] It is determined whether or not the sum $M_{d1}$ of move distances takes a value greater than or equal to a predetermined distance $D_{k2}$ (where $D_{k1}<D_{k2}$) ; if the sum $M_{d1}$ is greater than or equal to the predetermined distance $D_{k2}$, the flow proceeds to Step S144, and if not, the flow proceeds to Step S145.

[S144] An alarm sound V which is varied according to the following equation (1)

$$V=[\{(M_{d1}+A)-D_{k1}\}/A] \quad (1)$$

is emitted. In the equation, symbols [.] are in accordance with Gauss' notation, and $A=(D_{k2}-D_{k1})/B$, where B represents the degree of volume and is set to "10", for example.

[S145] The loudest alarm is sounded.

Thus, in this embodiment, the distance of movement is obtained based on the time interval $M_t$ between vibrations detected by the vibration sensors 31, 32 and the number of times vibration is repeated, and an alarm is issued when the move distance has become greater than or equal to the fixed value $D_{k1}$, whereby erroneous operation is prevented from being caused at the time of rearrangement or the like and an alarm can be issued through reliable detection of theft.

Also, since theft is detected based on the detection signal from the vibration sensing section 23, it is unnecessary to interlock the antitheft device mechanically with an apparatus which is the subject of monitoring. Accordingly, the overall structure and mounting of the antitheft device 10 can be simplified.

Further, the horizontal and vertical vibration sensors 31 and 32 are used as the vibration sensing section 23, and the timing for issuing an alarm is controlled in accordance with the pattern of generation of horizontal and vertical vibrations; therefore, theft can be prevented with higher reliability and also erroneous operation can be prevented.

In the foregoing embodiment, schedule management for time zone monitoring etc. is carried out, and therefore, an alarm sound is prevented from being emitted while the monitoring is not required. Also, the power supply time can be saved, prolonging the service life of the battery 22.

Although the above embodiment uses a mercury battery or the like as the battery 22, a solar battery may be used instead insofar as the antitheft device 10 can be mounted to a position where light falls upon the device.

As described above, according to the present invention, the distance for which a product has moved after the start of vibration is estimated based on the time interval between vibrations detected by the vibration sensor and the number of times vibration is repeated, and an alarm is issued when the estimated distance of movement has become greater than or equal to a predetermined distance, whereby the alarm is prevented from being issued when short-distance movement takes place such as at the time of rearrangement, and theft can be reliably detected.

Since the antitheft device need not be interlocked with a product and can be housed in a single casing, its structure and mounting are facilitated and also the size can be reduced.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An antitheft device attached to a product capable of being carried by hand, for detecting theft of the product and issuing an alarm, comprising:

a vibration sensor detecting a vibration of specified magnitude or more in horizontal and vertical directions;

move distance estimating means for estimating a distance of movement of the product from a start of vibration based on a time interval between vibrations detected by said vibration sensor and a number of times the vibration is repeated; and alarming means for issuing an alarm when the estimated distance of movement has become greater than or equal to a predetermined distance.

2. The antitheft device according to claim 1, wherein said move distance estimating means includes time interval calculating means for calculating a time interval between vibrations detected by said vibration sensor, unit move distance computing means for computing a unit distance of movement estimated to have been traversed during the calculated time interval, and adding means for adding up the unit distance of movement.

3. The antitheft device according to claim 2, wherein said unit move distance computing means computes the unit distance of movement such that a value thereof is inversely proportional to the time interval.

4. The antitheft device according to claim 1, wherein said alarming means sounds a louder alarm with increase in the estimated distance of movement.

5. The antitheft device according to claim 1, which further comprises schedule management means for managing a schedule for monitoring the theft, said schedule management means causing the monitoring to be executed only in a preset day of week or in a preset time zone.

6. The antitheft device according to claim 5, wherein said schedule management means includes calendar calculating means for calculating calendar data such as current time, day of week, day, month and year, monitoring condition storing means for storing data about a monitoring condition such as a day of the week and a time zone to be monitored and input beforehand, and monitoring condition determining means for determining whether or not the current calendar data fulfills the monitoring condition, and causing the monitoring to be executed only when the current calendar data fulfills the monitoring condition.

7. A method of detecting theft of a portable product having vibration sensor on the product, comprising:

detecting horizontal and vertical vibrations of the product using the sensor;

estimating a movement distance for the product responsive to a time interval between the vibrations; and issuing an alarm when the distance exceeds a predetermined value.

8. A method of detecting theft of a portable product, comprising:

estimating a movement distance of the product responsive to vibrations of a vibration sensor in horizontal and vertical directions and a time interval between vibrations; and issuing an alarm when the distance exceeds a predetermined value.

9. A method of detecting theft of a hand holdable, portable product having a vibration sensor, comprising:

detecting horizontal and vertical vibrations of the product using the vibration sensor;

determining a time interval between vibrations;

estimating a movement distance for the product responsive to the time interval; and issuing an alarm when the distance exceeds a predetermined value.

10. An apparatus for detecting theft of a portable product, comprising:

a vibration sensor coupled to the product and detecting horizontal and vertical vibrations of the sensor with the product; and a control section coupled to the sensor, estimating a movement distance of the product responsive to a time interval between the vibrations and issuing an alarm when the distance exceeds a predetermined value.

11. An apparatus for detecting theft of a portable product, comprising:

a vibration sensor coupled to the product and producing a vibration sensor signal responsive to vibration of the product; and a control section coupled to the sensor, estimating a movement distance of the product from the sensor signal from a time interval between the vibrations and issuing an alarm when the distance exceeds a predetermined value.

* * * * *